United States Patent [19]

Minasov et al.

[11] 4,345,867

[45] Aug. 24, 1982

[54] COKE DRY QUENCHING PLANT

[76] Inventors: Alexandr N. Minasov, ulitsa Ivanova, 12/16, kv. 59; Alexandr N. Suslov, ulitsa Karla Marxa, 38 E, kv. 42, both of Kharkov; Alexandr A. Azimov, ulitsa Oktyabrskoi revoljutsii, 25, kv. 11; Gennady N. Marapulets, ulitsa Lyzenko, 40, both of Slavyansk, all of U.S.S.R.

[21] Appl. No.: 128,503

[22] Filed: Mar. 10, 1980

[51] Int. Cl.[3] ..... C10B 39/02

[52] U.S. Cl. ..... 414/287; 105/177; 202/227

[58] Field of Search ..... 414/147, 162, 163, 167, 414/199, 267, 268, 269, 287; 202/227, 262; 104/48; 105/177

[56] References Cited

U.S. PATENT DOCUMENTS 3,450,062 6/1969 Pradon ..... 105/177

4,066,513 1/1978 Jablin ..... 202/227 X

*Primary Examiner*—Robert G. Sheridan

*Attorney, Agent, or Firm*—McAulay, Fields, Fisher, Goldstein & Nissen

[57] ABSTRACT

A coke quenching plant comprises vertical quenching chambers arranged in a row and each having a coke-charging means installed in the upper part thereof, hoisting shafts, each of which is located opposite a corresponding quenching chamber, and lifts. Each of the lifts is provided with a carriage transporting a body for carrying coke upwards from the hoisting shaft to the coke-charging means, and downwards. Also provided in the plant is a trestle installed along the quenching chambers on the level of the lifts coming out from the hoisting shafts, and a means for transferring the carriage of the lift in horizontal plane along the trestle and perpendicularly thereto.

7 Claims, 16 Drawing Figures

COKE DRY QUENCHING PLANT

BACKGROUND OF THE INVENTION

1. Field of the Invention

The invention relates to the coke-and-chemical industry and more particularly to coke dry quenching plants.

It is most expedient to employ the present invention in combination with modern high-efficiency coke oven batteries.

2. Previous Art

As is generally known, the coke production process ends with the delivery of coke from ovens at a temperature of 950°-1100° C. To prevent incandescent coke from burning after discharging from the oven, and to make it suitable for transportation and storage, its temperature must be decreased down to 250°-100° C., i.e. coke must be quenched.

Dry quenching, the most progressive method of coke quenching, makes it possible not only to improve the quality of the coke, but also the technical and economic factors of blast-furnace smelting, the working conditions in coke oven plants, as well as to solve to a considerable extent the problem of the protection of environment against harmful impurities.

Today all newly-built coke batteries are provided with coke dry quenching plants (now and in the remainder of the specification abbreviated as CDQP). Such plants may have a great variety of embodiments.

Thus, for instance, known in the art is a coke dry quenching plant (cf. M.G. Teplinsky and others. Sukhoye tushenie koksa. "Metallurgia." 1971. p. 52) comprising quenching chambers arranged in a row parallel to the front of the coke ovens. All the quenching chambers are encased in a metal framework in whose upper part there are rails for lifts to move on. One hoisting shaft is provided for a group of quenching chambers (2-4 chambers), the hoisting shafts being arranged in a row with the quenching chambers. In the lower part of each of the shafts there is mounted a means for pulling off a car body with incandescent coke from the carriage of a coke-carrying car, and for transferring the body to the hoisting shaft centre. It should be pointed out that incandescent coke is delivered to the chambers by two coke-carrying cars which are transferred by an electric locomotive, parallel to the front of the quenching chambers.

In the above coke dry quenching plant, however, the body with incandescent coke is transported for a considerable distance past a number of the quenching chambers before coke is discharged to one of the chambers. For instance, to charge the chamber which is the fourth in succession from the shaft, the body has to cover the distance of over 50 meters. During this time, the incandescent coke has thermal effect not only on the body itself, but also on the CDQP framework and the lift, which results in a premature damage or intensive wearing of the equipment, in the arising of emergency situations, and a decrease of the CDQP operation efficiency as a whole. Machines' work schedule becomes more complicated and extended in time. Coke burning proceeds at a higher rate. The employment of the means for pulling off the body with incandescent coke from the carriage of the coke-carrying car also decreases the plant efficiency. In addition, during work, the number of runs of the electric locomotive with the two coke-carrying cars to one and the same shaft will depend on the number of quenching chambers to be served. As a result, thermal effect upon the CDQP structures increases.

To a certain extent the above drawbacks are eliminated in a coke dry quenching plant (cf. N. K. Kulakov and V. S. Kononenko. Sravnitelnaya kharakteristika raboty sovetskoi i frantsuzskoi ustanovok sukhogo tushenia koksa. "Koks i Khimia," 1975, No. 5, pp. 22-25). Which comprises vertical quenching chambers arranged in a row and having upper charging holes, and also hoisting shafts, each located opposite a corresponding quenching chamber. Each of the hoisting shafts in the present plant is provided with a lift having, in turn, a carriage for transferring a coke-loaded body from the hoisting shaft to the quenching chamber charging hole. Incandescent coke is delivered to the chambers by two coke-carryng cars transported by an electric locomotive.

With such a design of the CDQP, the distance covered by the lift and the car body is less than that in the aforedescribed embodiment, though its technical realization is somewhat complicated. Thus, an eight-chamber CDQP must have eight hoisting shafts and eight lifts. In addition, machines' work schedule becomes more complicated as a result of operations carried out by the coke-carrying cars. When using two coke-carrying cars, the electric locomotive has to make two runs to the same shaft in order to pass the body with incandescent coke thereinto, and then to take back the empty body. While receiving the empty body, the electric locomotive brings another body loaded with incandescent coke to the shaft, thereby increasing thermal effect upon the CDQP structures.

SUMMARY OF THE INVENTION

The principal object of the invention consists in providing a coke dry quenching plant which, due to a greater manoeuverability of the lift, is more efficient in operation and needs fewer auxiliary machines.

It is also an object of the invention to make the plant more economic and efficient.

Another object of the invention consists in decreasing thermal effect on the machines' metallic structures and the CDQP outfits.

Still another object of the invention consists in simplifying control of the hoisting and transporting means.

A further object of the invention consists in shortening the idle time.

In addition, it is an object of the invention to increase the manoeuvrability of the coke-carrying cars.

A possible object of the invention consists in providing a plant which is durable and reliable in operation.

It is also an object of the invention to reduce expenses for repair and maintenance.

No less an important object of the invention consists in decreasing the coke furnace loss and reducing the amount of harmful impurities discharged into the atmosphere.

One of the objects of the invention consists in decreasing the consumption of metal for the proposed CDQP production.

These and other objects of the invention are accomplished in that a coke dry quenching plant, comprising vertical quenching chambers arranged in a row and having upper charging means, hoisting shafts, each being located opposite a corresponding quenching chamber, and lifts, each provided with a carriage for transporting a coke-loaded body upwards from a hoisting shaft to a charging means of a corresponding quenching chamber and the empty body therefrom, according to the invention, is provided with a trestle mounted along the quenching chambers at the level of the lifts coming out from the hoisting shafts and with a means for transferring the carriage of the lift in a horizontal plane along the trestle and perpendicularly thereto.

It is advisable that the means for transferring the carriage of the lift in the horizontal plane along the trestle and perpendicularly thereto be made in the form of a platform having an undercarriage resting upon the trestle, rails intended for the lift carriage to move on towards the charging hole of a corresponding quenching chamber being load onto the platform perpendicularly to the longitudinal axis of the trestle.

In this case it is possible that the trestle and said platform with its undercarriage resting thereupon be located on one side of the quenching chambers so that the trestle longitudinal axis pass through the hoisting shafts centres.

It is also possible that the above platform be located above the hoisting shafts and the charging holes of the quenching chambers, while the undercarriage of the platform rests upon the trestle installed on both sides of the quenching chambers.

In addition, it is expedient that the means for transferring the coke-loaded body in horizontal plane along the trestle and perpendicularly thereto comprise four pairs of driven balance trucks which, in effect, are the undercarriage of the lift carriage, and one of the balance trucks in each of the pairs is adapted for being lifted and located perpendicularly to the other one.

It is also expedient that the means for transferring the coke-loaded body in the horizontal plane along the trestle and perpendicularly thereto comprise four pairs of driven balance trucks which, in effect, are the undercarriage of the lift carriage, and each of the trucks being made for rotation around the vertical axis, while the lift carriage being provided with a jack.

Such an embodiment of the plant makes it possible to transfer the coke-loaded body in two perpendicular to each other directions in a horizontal plane corresponding to the position of the quenching chambers charging means. This enables the number of operating machines to be decreased (as a result of a better manoeuvrability of the lifts) and the efficiency of the plant increased.

BRIEF DESCRIPTION OF THE DRAWINGS

The above-mentioned and other objects of the invention will become clearer from a detailed description of specific embodiments of the invention made with reference to the accompanying drawings in which.

The description of a coke dry quenching plant comprising eight quenching chambers is given below.

Figure 1:
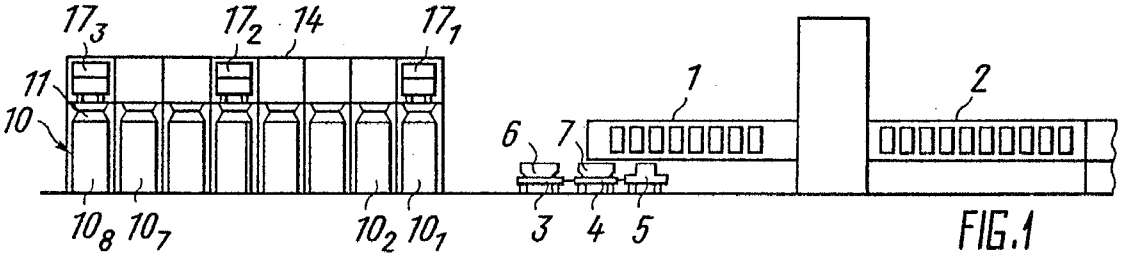
FIG. 1 is a schematic layout of the CDQP, coke oven battery and coke-carrying cars.
Figure 2:
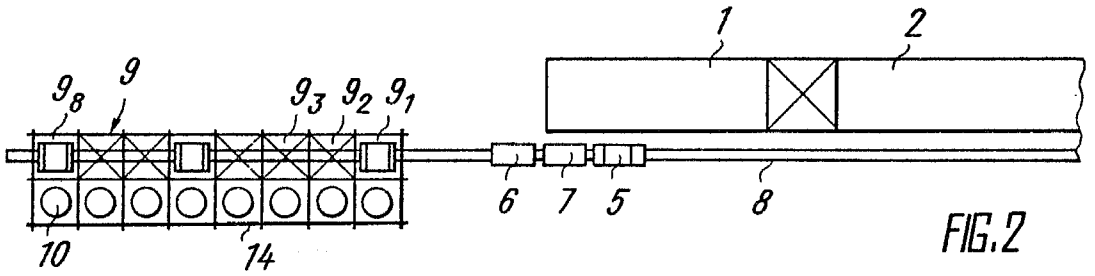
FIG. 2 shows the same as FIG. 1, in plan view.

As is shown in FIGS. 1 and 2, the CDQP is located near the coke oven batteries 1 and 2 parallel to the front of coke ovens. The CDQP is served by two coke-carrying cars 3 and 4 transferred by an electric locomotive 5. The coke-carrying cars 3 and 4 are provided with removable bodies 6 and 7. The coke-carrying cars 3 and 4 are transferred along a railway line 8 (FIG. 2) laid parallel to the front of the coke ovens in the batteries 1 and 2, under the hoisting shafts 9 of the CDQP.

Figure 3:
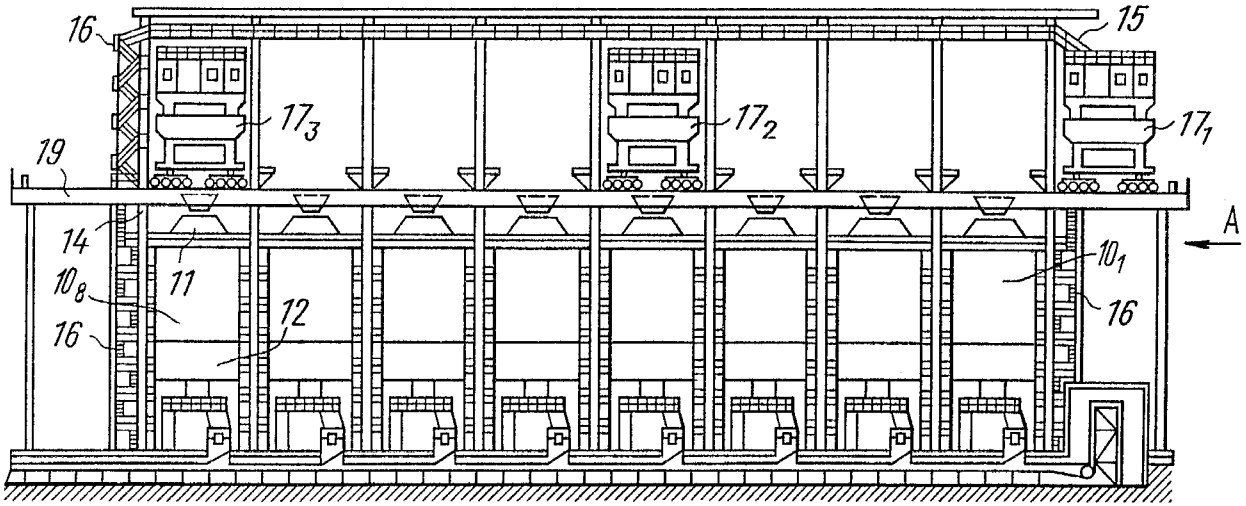
FIG. 3 is a general view of a coke dry quenching plant, according to the invention.

CDQP comprises quenchng chambers $10_{1-n}$, arranged in a row parallel to the front of the coke ovens (n=8). In the upper part, each of the quenching chambers has a charging means 11 for charging incandescent coke into the quenching chamber 10, while in the lower part there is a device 12 (FIG. 3) for discharging quenched coke to a conveyor 13. The quenching chambers 10 are encased in a metallic framework 14 provided with walking platforms 15 and stairs 16.

Opposite each of the quenching chambers 10 there are hoisting shafts $9_{1-n}$ provided with guides (not shown in drawings) for lifts $17_{1-m}$ to move in. CDQP has three lifts (m=3), one of which is a stand-by lift. Each lift 17 has a carriage 18 for transferring the bodies 6 and 7 upwards from the hoisting shaft 9 to the coke-charging means 11 of the quenching chamber 10, and downwards.

Figure 4:
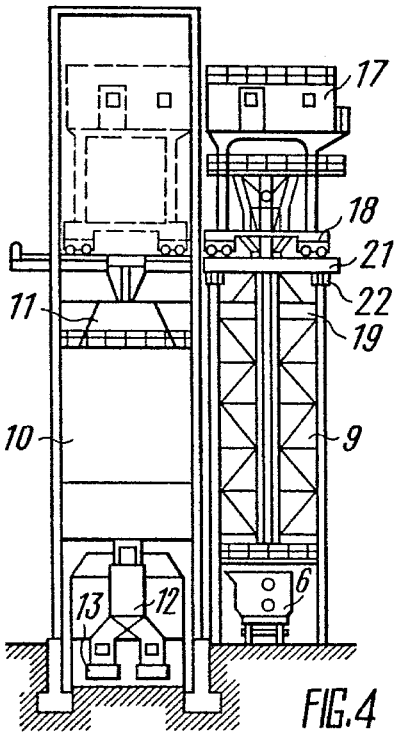
FIG. 4 shows an alternative embodiment of the plant, wherein the trestle and the platform with its undercarriage resting thereupon are located on one side of the quenching chambers, view taken along arrow A of FIG. 3.
Figure 10:
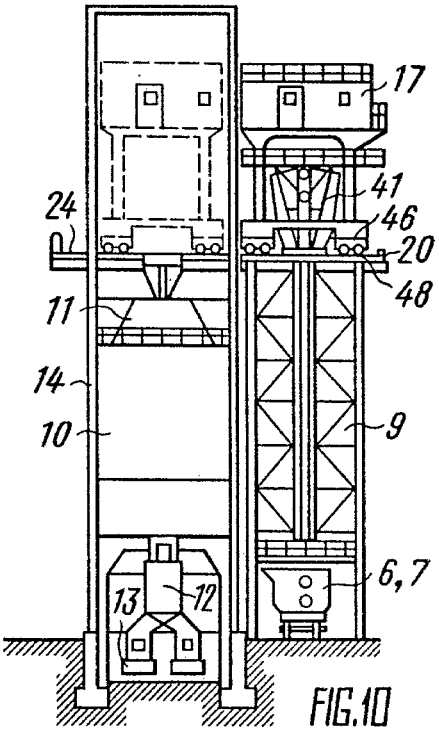
FIG. 10 shows an alternative embodiment of the means for transferring the lift carriage in a horizontal plane along the trestle and perpendicularly thereto, according to the invention, and provided with four pairs of balance trucks.
Figure 5:
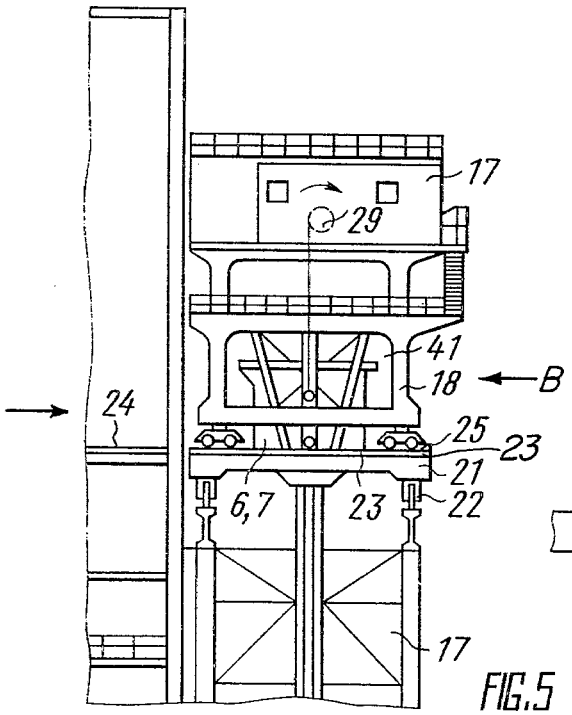
FIG. 5 shows a detail of FIG. 4.
Figure 6:
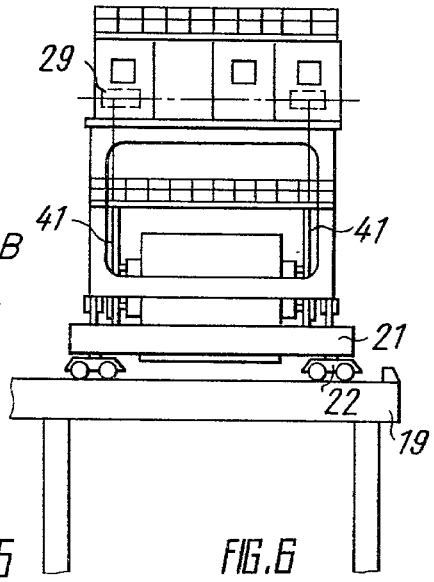
FIG. 6 shows the same detail of FIG. 4 as FIG. 5, with the view taken along arrow B of FIG. 7.

According to the invention, along the quenching chambers 10 and at the level of the lifts 17 coming out from the hoisting shafts 9, there is built a trestle 19 with rails 20 (FIGS. 4, 5 and 6). Also provided is a device for transferring the carriage 18 of the lift 17 in horizontal plane along the trestle 19 and perpendicularly thereto. This makes it possible to increase the manoeuvrability of the lifts 17 in two reciprocally perpendicular directions in the horizontal plane, and to limit the number of the lifts to two pieces for serving 4–5 and even more quenching chambers, as well as to improve the efficiency of the plant as a whole.

FIG. 4 shows an alternative embodiment of a coke dry quenching plant according to which the device for transferring the carriage 18 of the lift 17 in horizontal plane along the trestle and perpendicularly thereto is made in the form of a platform 21 with its undercarriage 22 resting upon the trestle 19. On the platform 21, perpendicularly to the longitudinal axis of the trestle 19, there are laid rails 23 providing for transferring the carriage 18 of the lift 17 towards the charging means 11 of a corresponding quenching chamber 10, and therefrom.

The trestle 19 (FIGS. 4, 5 and 6) and the platform 21 moving thereupon are located on one side of the quenching chambers 10. In this case the longitudinal axis of the trestle 19 passes through the centre of each of the holes of the hoisting shafts 9. To transfer the lift to the charging means 11 of the quenching chamber 10 perpendicularly to the trestle 19, the rails 23 are laid on the platform 21, and rails 24 on the CDQP framework, at the same level. When on the platform 21, the lift 17 is fixed thereto by clamps 25. Such an embodiment is rather convenient.

Figure 7:
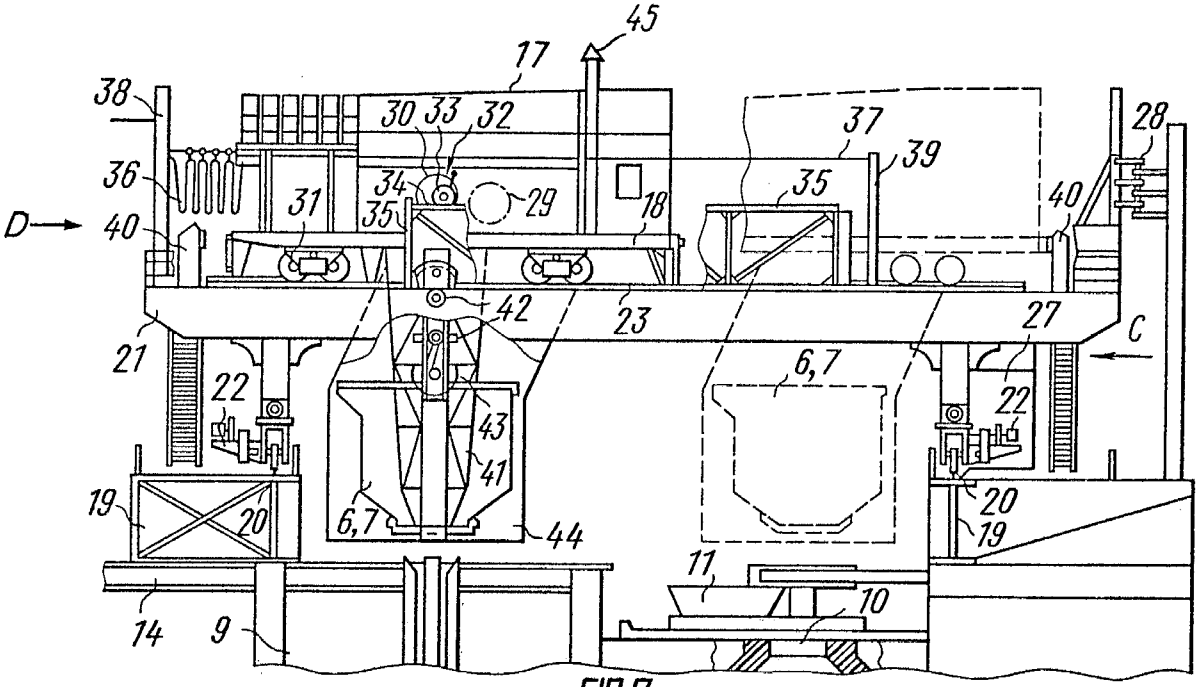
FIG. 7 shows the platform with the lift mounted thereupon, according to the invention, and a partial sectional view of the quenching chamber upper part.
Figure 8:
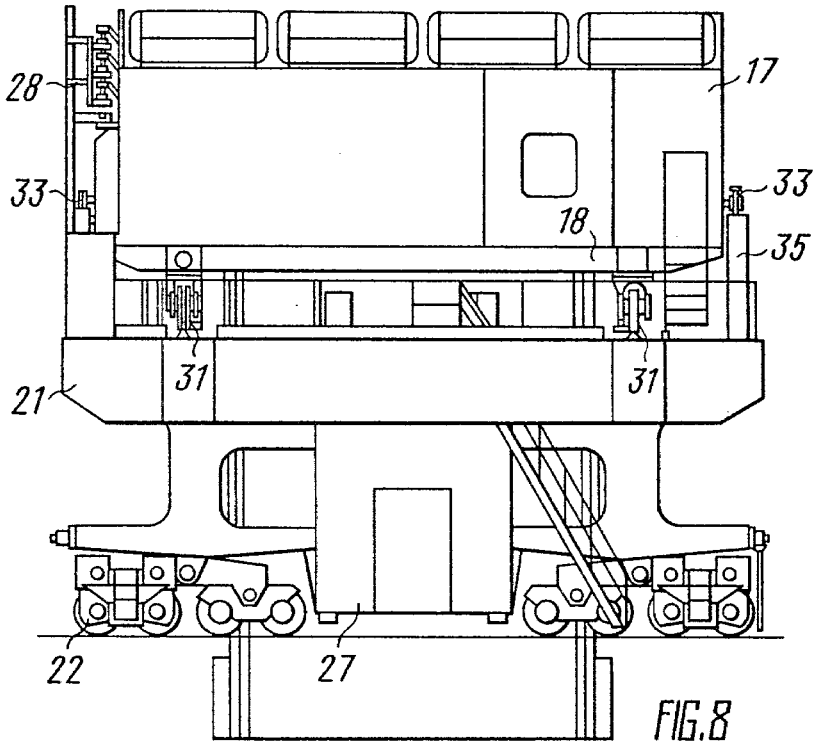
FIG. 8 shows the same as FIG. 7, view taken along arrow C of FIG. 7.
Figure 9:
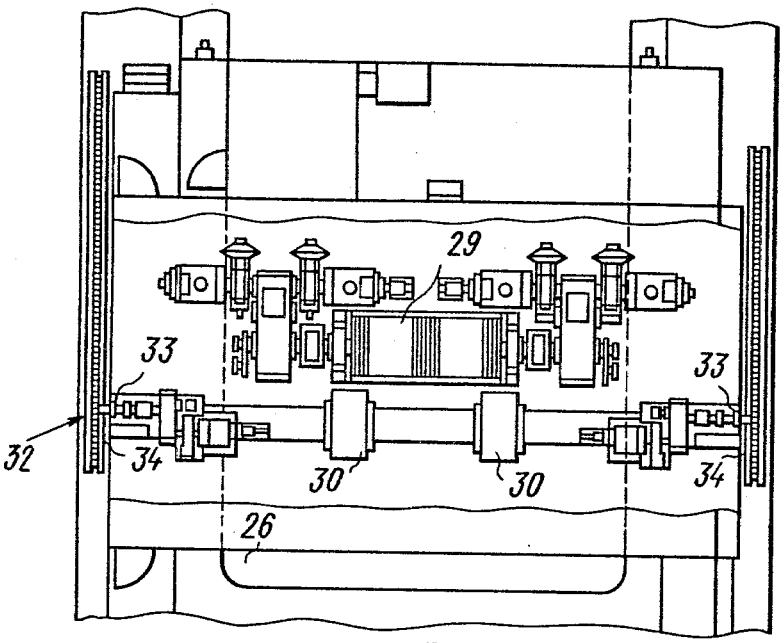
FIG. 9 shows the lift with a partial sectional view of the box, taken along arrow D of FIG. 8.

With another embodiment of the plant (FIGS. 7, 8 and 9), the 19 is mounted on the framework 14 on both sides of the quenching chambers 10, which the platform 21 is located above the hoisting shafts 9 and the quenching chambers 10. In this case the undercarriage 22 of the platform 21 rests upon the rails 20 laid on the trestle on both sides of the quenching chambers 10, and the rails 23 on the platform 21 link the hoisting shafts 9 with a corresponding charging means 11 of the quenching chambers 10. The platform 21 has a horizontal opening 26 through which there pass lift guides and freight-catching devices. All the start-control devices for the drives (balance trucks) of the under-carriage 22 of the platform 21 are enclosed within a box 27. Current supply is effected through collectors 28 (FIG. 7).

The CDQP lift 17 is, in effect, a crane trolley with a rope drum 29 and rope sheaves 30 mounted thereupon. Rotation of said drum is effected by an electromechanical drive. An undercarriage 31 of the carriage 18 of the lift 17 can be made in the form of balance trucks.

The transfer of the lift 17 on the platform 21 is effected by a gear drive 32, comprising a cogwheel 33 and a gear rack 34. The gear rack 34 is fixed on a truss 35 mounted on the platform 21. The gear drive 32 is located on both sides of the CDQP lift 17. Current supply to the drives of the lift 17 is accomplished through a flexible cable 36 suspended on a wire rope 37 stretched between posts 38 and 39, or through a trolley. The range of movement of the lift 17 is limited by stops 40.

The lift is also provided with a load-holding device comprising guides 41 in which a hook 43 is moved with the aid of rollers 42. During transportation, said hook holds suspended the body 6 or 7 of the coke-carrying car. The body 6 (7), the guides 41 and the freight-catching hooks 43 are enclosed in a case 44 due to which dust and gas are delivered into a ventilating pipe 45. To allocate the above devices, the platform 21 is provided with the horizontal opening 26 (in FIG. 9 designated with a dotted line).

The above embodiment is the most expedient for there is no need to join the rails 23 on the platform 21 to each of the railway lines 24 above the charging means 11 of the quenching chambers 10.

In the CDQP embodiment shown in FIGS. 10, 11, 12 and 13, the device for transferring the car 18 of the lift 17 in horizontal plane along the trestle 19 and perpendiculary thereto comprises four pairs of driven balance trucks: four balance trucks 46 being intended for transferring the lift 17 along the rails 20 of the trestle 19, and the other four balance trucks 47 along transverse rails 48 of the trestle and along the rails 24 of the CDQP framework. The rails 48 and 24 are laid on the same level. To put the balance trucks alternately on corresponding rails, the lift is provided with hoisting jacks 49.

The balance truck 47 for transferring the lift 17 to the charging means 11 of the quenching chamber 10 is made for raising, and, while the lift 17 is moving along the trestle 19, is found in the extreme upper position passing above the rails 48 with a certain clearance.

The balance truck 47 (FIG. 13) is mounted for moving on a frame rising in guides 50. The trucks 47 are transferred by a hydraulic drive 51 (FIG. 13) through lever-joint gear, having links 52 and 53. A joint 54 of the link 52 is fixed on the carriage 18 of the lift 17.

Figure 15:
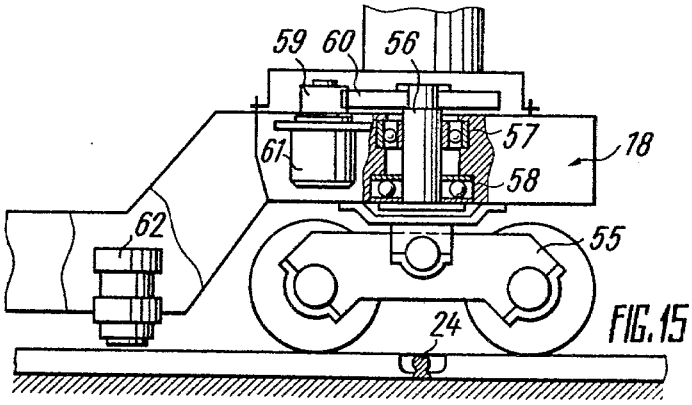
FIG. 15 shows a detail of FIG. 14, viewed from the side of the quenching chambers.
Figure 11:
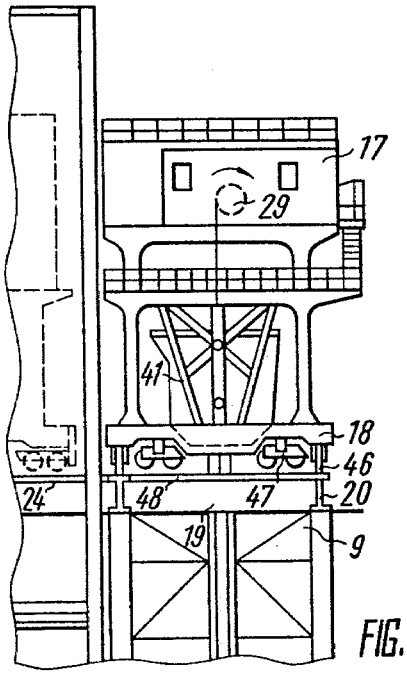
FIG. 11 shows the same as FIG. 10, viewed from the side of the quenching chambers.
Figure 14:
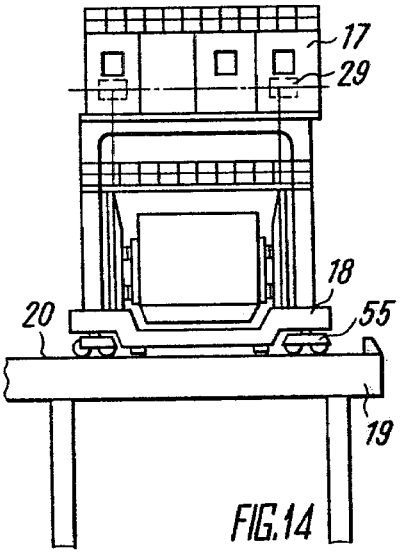
FIG. 14 is a general view of an alternative embodiment of the plant, according to the invention, provided with the means for transferring the lift carriage, which, in effect, are balance trucks made for raising and rotation.
Figure 12:
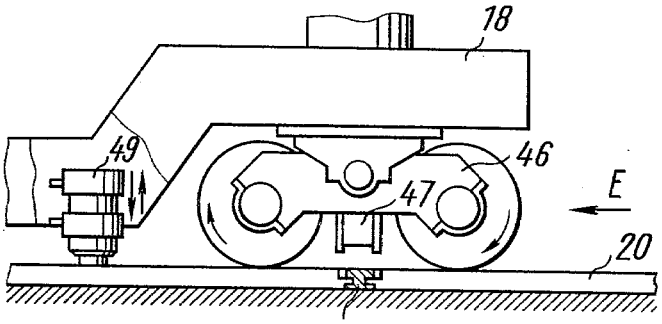
FIG. 12 shows the same as FIG. 10, viewed from the side of the trestle.
Figure 13:
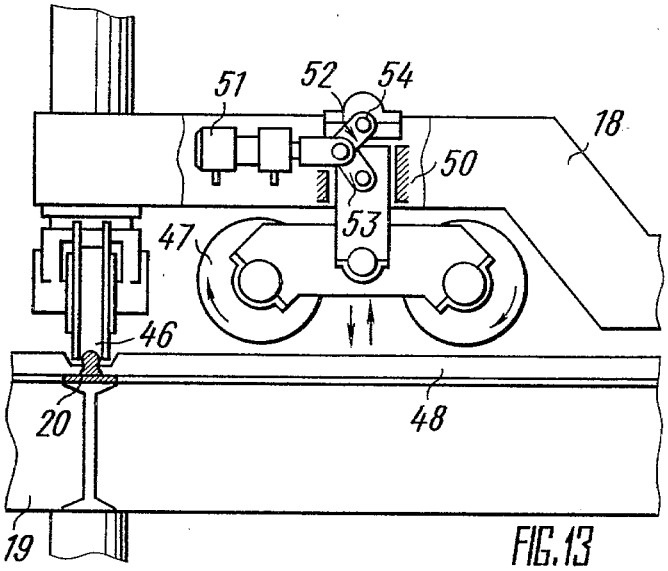
FIG. 13 shows the same as FIG. 10, view taken along arrow E of FIG. 12.

FIGS. 14 and 15 show another embodiment of the plant according to which the device for transferring the carriage 18 of the lift 17 in horizontal plane along the trestle 19 and perpendicularly thereto comprises four balance trucks 55. Each of said balance trucks 55 is mounted on a vertical axle 56 in bearing 57 and 58 fixed on the carriage 18 of the lift 17. Rotation of the carriage 18 through 90° is effected by gear drives 59 and 60 of an electric drive 61. To raise the lift 17 during rotation through 90°, there are provided hoisting jacks 62 mounted in the framework thereof.

Figure 16:
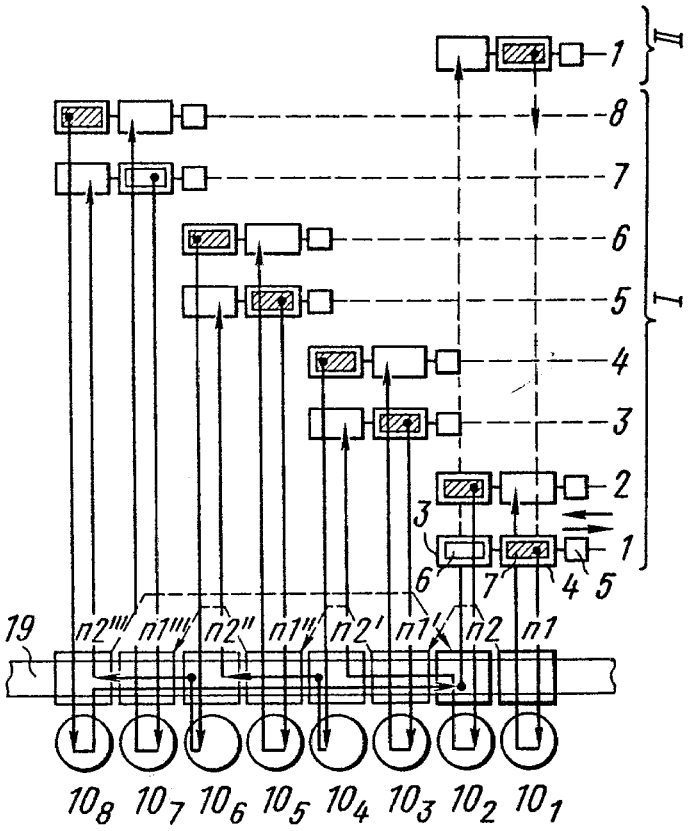
FIG. 16 is a diagram of the plant work schedule.

The coke dry quenching plant operates as follows (FIGS. 1, 2, 16). The two coke-carrying cars 3 and 4, are transferred by the electric locomotive 5 along the railway line 8, to deliver incandescent coke from the coke oven batteries 1 and 2 to the CDQP. Said railway line is parallel to the front of the coke ovens and quenching chambers and passes under the hoisting shafts 9. Each of the coke-carrying cars 3 and 4 is provided with the removable bodies 6 and 7 into which coke is discharged from the coke ovens. According to the work schedule of the coke ovens, a train of the two coke-carrying cars 3 and 4 and the electric locomotive 5 serves the two coke oven batteries 1 and 2.

The work schedule of the CDQP lift 17 and the coke-carrying cars 3 and 4 is shown in FIG. 16. To make it clearer, it is assumed that the beginnng of work coincides in time with the beginning of charging coke into the first quenching chamber $10_1$. The rest of the chambers are charged in consecutive order, from $10_2$ to $10_8$.

Once the eighth chamber is charged, the cycle is repeated. Conventionally, it is considered that all the chambers are charged, i.e. no stand-by chambers are involved. In fact, the presence of stand-by chambers or any change in regular succession of charging the chambers does not interfere with the principle and order of work of the lifts and coke-carrying cars.

As machines start working, the electric locomotive 5 transfers the coke-carrying cars 3 and 4 with the empty bodies 6 and 7 to the coke furnace battery 1 where the body 7 of the car 4 is loaded. During this time, the lifts $17_1$ and $17_2$ are found on the trestle 19 above the hoisting shafts $9_1$ and $9_2$ respectively of the chambers $10_1$ and $10_2$.

After coke is discharged from one of the ovens of the coke oven battery 1, the train (the locomotive 5 and the coke-carrying cars 3 and 4 with the bodies 6 and 7 mounted thereupon) returns to the CDQP and stops precisely under the hoisting shafts of the chambers $10_1$ and $10_2$. The overall dimension of the train is in conformity with that of the hoisting shafts so that the bodies 6 and 7 of the coke-carrying cars 3 and 4 match the hoisting shafts openings. In this position, the lift $17_1$ clamps the coke-loaded body 7 of the car 4 and transfers it to the chamber $10_1$ to charge. During this time, the lift $17_2$ remains on the trestle 19 above the hoisting shaft $9_2$ of the chamber $10_2$, waiting for coke delivery, while the train returns to the coke ovens, and the body 6 of the coke carrying car 3 is loaded with coke from one of the ovens of the coke furnace battery 2.

With the coke-loaded body of the car 3, the train moves to the CDQP and again stops under the hoisting shafts $9_1$ and $9_2$ of the chambers $10_1$ and $10_2$ (like in the previous run).

In this position, the lift $17_1$ returns the empty body 7 onto the car 4, while the lift $17_2$ removes the coke-loaded body 6 from the car 3 and transfers it to the chamber $10_2$.

At the very same moment the train returns to the coke furnace battery 1, and the body 7 of the car 4 is charged with coke from the next oven.

From the aforedescribed two runs of the train (FIGS. 1, 2, 16) it follows that the bodies 7 and 6 of the cars 4 and 3 are loaded with coke in succession from the coke furnace battery 1 and 2 respectively, and the two lifts also operate in turn: as one is raising the coke-loaded body to the CDQP top, the other descends the empty body onto the coke-carrying car.

To feed coke into the quenching chambers $10_3$ and $10_4$, both lifts are transferred along the trestle 19 and stop under the hoisting shafts $9_3$ and $9_4$ respectively. The lift $17_2$ with the empty body moves to the shaft $9_4$, and the lift $17_1$, without a body, to the shaft $9_3$. Then both cars will wait for the arrival of the coke-loaded train.

During the third run, the lift $17_1$ removes the coke-loaded body 7 from the car 4, and the lift $17_2$ descends the empty body onto the car 6. While feeding coke into the chamber $10_3$, the train returns to the coke furnace battery 2 and the body 6 of the car 3 is charged with coke from the next oven. Then the train returns to the CDQP, making the fourth run. In this position, the lift $17_1$ descends the body 7 onto the car 4, and the lift $17_2$ removes the body 6 from the car 3 and transfers it to the chamber $10_4$.

The succession of feeding coke into the chambers $10_{5,6,7,8}$ can be seen in the graph (FIG. 16). To effect said feeding, the train makes the fifth, sixth, etc. runs. On feeding coke into the chamber $10_7$ and putting the body 7 onto the car 4, the lift $17_1$ completes the first feeding cycle and returns to the charging means 11 of the chamber $10_1$ along the trestle 19, and the lift $17_2$ with the empty body, after charging the chamber $10_8$, returns to the shaft of the chamber $10_2$. Here, the both lifts wait for the train to make the first run to effect the second cycle of feeding coke to the chambers. The second cycle proceeds in the same order as the previous aforedescribed cycle.

Thus, both of the lifts (the lift $17_3$ in FIGS. 1, 2 is a stand-by lift) interact with the coke-carrying cars and move on the trestle and the framework 14 of the quenching chambers 10 in reciprocally perpendicular directions.

The change of directions is effected by the device for transferring the carriage 18 of the lift 17 in the horizontal plane along the trestle 19 and perpendicularly thereto; said device may have various embodiments. If the device is made in the form of the platform 21 transferred on the trestle 19 installed on both sides of the quenching chambers 10 (FIGS. 7, 8 and 9), the change of the direction of movement of the lifts is effected as follows. The lift 17 is found on the platform 21, with its undercarriage 31 resting upon the rails 23 fixed to the platform 21 framework. In working position the lift 17 is under the hoisting shaft 9, as shown in FIG. 4, waiting for the arrival of the coke-carrying cars 3 or 4 with the coke-loaded body 6 or 7.

When the coke-loaded body 6 or 7 assumes the position under the hoisting shaft 9 of the successive quenching chamber 10 to be charged, the rope drum 29 of the lift 17 is started, while the hooks 43 are descended onto the body 6 or 7 (in FIG. 7 it is shown in extreme upper position) and automatically catch the body 6 or 7 by its journals (not shown in drawings). To raise the body 6 or 7, the drum 29 of the lift 17 is started again, thereby lifting said body 6 or 7 to the plant top. The guiding rollers 42 of the hooks first move in the guides of the hoisting shaft 9 and then in the guides 41 of the lift 17, thereby preventing the body from swinging when lifted. When the body 6 or 7 reaches the extreme upper position, the drum 29 is cut out automatically.

The next operation is the transportation of the coke-loaded body 6 (7) to the charging means 11 of the quenching chamber. To this end, the drives of the undercarriage 31 are started and the lift 17 is transferred to the next position to stop automatically above the quenching chamber 10 to be charged (in FIG. 7 designated with a dotted line). In this position, the drum 29 of the lift 17 is started again, the body 6 or 7 descends onto the charging means 11 and discharges incandescent coke into the quenching chamber 10 (the discharging process and the design of the CDQP discharging means are not described in the present Application).

Once coke is discharged, the body 6 or 7 is raised to the extreme upper position, and the lift 17 returns again to its initial position, as shown in FIG. 7. When the lift 17 reaches its initial position, the drives of the platform 21 undercarriage 22 are started and the platform 21 is transferred to the charging means 11 of the next quenching chamber 10 to be charged and waits for the arrival of the empty car 3 or 4. The moment the empty car assumes the position under the hoisting shaft 9, the drum 29 is started and the empty body 6 or 7 descends onto the carriage of the coke-carrying car.

When the body 6 or 7 reaches the extreme lower position, the hooks 43 open automatically, thereby releasing the body. Remaining open, the hooks 43 are drawn upwards for a certain height and the lift 17 waits for the arrival of the next coke carrying car with the coke-loaded body. The raising of the coke-loaded body proceeds in the same order as described before.

If the device for transferring the carriage 18 of the lift 17 in horizontal plane along the trestle and perpendicularly thereto is made in the form of the platform resting upon the trestle 19 mounted on one side of the quenching chambers 10 (FIGS. 4, 5, 6), the machines working procedure is as follows. In the initial position, the lift 17 is found on the platform 21 as shown in FIG. 4, fixed on the rails 23 of the platform 21 by the clamps 25. Such position of the lifts 17 enables the platform 21 to be transferred above the shafts 9 and along the trestle 19.

To raise the body 6 or 7 loaded with incandescent coke, the platform 21 is stopped under a given hoisting shaft 9 and the platform undercarriage 22 is fixed on the rails. The lift 17 lowers the hooks 43 onto the body 6 or 7, catches the coke-loaded body and raises it to the extreme upper position. Then the drives of the lift 17 undercarriage are started, and said lift moves along the rails 23 and 24 to the quenching chamber to be charged. The lift operates in the same succession as described before and shown in FIG. 16. Once coke is discharged, the lift 17 with the empty body returns onto the platform 21 and is fixed thereupon by the clamps 25. With the lift 17 in such position, the platform is transferred to the next hoisting shaft 9. The descent of the empty body onto the carriage of a corresponding coke-carrying car proceeds in the same order as described before.

FIGS. 10, 11, 12 and 13 show an alternative embodiment of the device for transferring the carriage 18 of the lift 17, comprising the reciprocally perpendicular driven balance trucks 46 and 47. As the lift 17 is moving on the trestle 19, the drives of the balance truck 46 are started, and the truck 47 is in the extreme upper position.

To transfer the lift 17 to the quenching chamber 10 perpendicularly to the trestle 19, said lift is stopped in the position along the axis of a corresponding quenching chamber 10, and the hoisting jacks 49, effecting the raising of the lift 17 to a certain height, are started. After that, the hydraulic drive 51 is cut in, and the driven balance trucks 47 are descended onto the rails 48 and fixed in the lift 17 framework. Then, the jacks 49 are rendered cut out and the lift 17 descends on the rails 48. On starting the drives of the trucks 47, the lift 17 is transferred along the rails 48 and 24 to the quenching chamber 10. After the lift 17 returns onto the trestle 19, all the operations are repeated in reverse order.

The change of the direction of movement of the lift, provided with the balance trucks 55 (FIGS. 14, 15) made for raising and rotation, is effected as follows. The lift 17 is stopped in the position along the axis of the quenching station 10, the hoisting jacks 62 are cut in, and the lift 17 is raised to a certain height. Then the drive 61 is started and the driven balance truck 55 is rotated through 90° so that its wheels stop along the axis of the rails 24 of the quenching stations 10 and framework 14. After that the jacks 62 are cut out and the lift descends onto the rails 24. On starting the drives of the trucks 55, the lift 17 is transferred to the quenching chamber 10. After the lift returns onto the trestle 19, all the operations are repeated in reverse order.

The use of the proposed coke dry quenching plant in the coke-and-chemical industry will make it possible to decrease the number of operating machines and to increase the efficiency of the CDQP due to the fact that the introduction of the additional trestle and the device for transferring the lift carriage in horizontal plane along the trestle and perpendicularly thereto enables the lifts to be transferred in two reciprocally perpendicular directions, thereby minimizing the distance to be covered by the lifts.

In this case, coke melting loss, as well as thermal effect on the CDQP metallic structures, machines and outfits are decreased.

The device for transferring the lift carriage, provided for each of the lifts, enables two lifts to serve simultaneously two neighbouring quenching chambers and two coke-carrying cars, which also increases the coke-carrying cars manoeuvrability. In turn, by shortening the distance and time of transferring the lift with the body and the body with incandescent coke above the CDQP structures (for the lifts are transferred on the trestle), the service life of the lifts and the bodies is considerably increased. The machines' high manoeuvrability also makes it possible to reduce pollution of atmosphere with harmful impurities.

Reduction of the number of the lifts, decrease of expenditures for their repair and maintenance, as well as decrease of coke melting loss, results in a considerable economic effect.

Due to minimizing thermal effect upon the structures and outfits, their service life is increased and expenditures for their repair reduced.

It is quite obvious that along with the aforedescribed embodiments other embodiments are also possible of a coke dry quenching plant, according to the invention, without departure from the spirit and scope defined by the claims.

We claim:

1. A coke dry quenching plant comprising:

vertical quenching chambers, said chambers each being arranged in a row and each including an associated coke-charging means corresponding thereto and installed in an upper part thereof;

hoisting shafts, one of said hoisting shafts for each said vertical quenching chambers, and each said hoisting shaft being mounted opposite an associated one of a corresponding vertical quenching chamber;

a body for carrying coke;

lifts operatively movable relative to and interacting with said hoisting shafts, each said lift including a carriage for transporting said body from one of said hoisting shafts to and from the coke-charging means of its said corresponding vertical quenching chamber;

a trestle justaposed to an exit end of said hoisting shafts, rails on said trestle and positioned on a level thereof where said lift exits from said exit of said hoisting shafts, said body being movable on said trestle and guided by said rails for movement along said vertical quenching chambers;

a railway line laid on a side of said vertical quenching chambers on a level of the location of said rails of said trestle perpendicularly to said rails and interacting with said undercarriage of said lift carriage; and means for transferring said body in a horizontal plane along said trestle and perpendicularly thereto.

2. The plant according to claim 1, wherein said means for transferring said lift carriage in said horizontal plane along said trestle and perpendicularly thereto is a platform, comprising:

an undercarriage resting upon said rails of said trestle;

a trestle positioned on both sides of said vertical quenching chambers;

said platform being located above said hoisting shaft and said coke-charging means of said vertical quenching chamber; and, rails laid on a frame work of said quenching chamber perpendicularly to the longitudinal axis of said trestle and interacting with said lift carriage thereby providing for the movement of said carriage towards said coke-charging means of said vertical quenching chamber.

3. A coke dry quenching plant, comprising:

vertical quenching chambers arranged in a row and each including a corresponding coke-charging means installed in an upper part thereof;

a hoisting shaft for each of said vertical quenching chambers, and each said hoisting shaft being installed opposite its corresponding vertical quenching chamber;

a body for carrying coke;

lifts interacting with said hoisting shafts, and each said lift including a carriage for transporting said body from and to one of said hoisting shafts to said coke-charging means of its said corresponding vertical quenching chamber, and said lift carriage including an undercarriage;

a trestle juxtaposed to an exit end of said hoisting shafts, rails on said trestle and positioned on a level thereof where said lift exits from said exit of said hoisting shafts, said body being movable on said trestle and guided by said rails for movement along said vertical quenching chambers;

a railway line laid on a side of said vertical quenching chambers on a level of the location of said rails of said trestle perpendicularly to said rails and interacting with said undercarriage of said lift carriage; and means for transferring said body in a horizontal plane along said trestle and perpendicularly thereto.

4. A plant according to claim 3, wherein said means for transferring said lift carriage in a horizontal plane includes:

a platform having an undercarriage interacting with said rails of said trestle, said platform being located on the side of said hoisting shafts so that a longitudinal axis of said trestle passes through the centres of said hoisting shafts; and platform rails laid on said platform perpendicularly to a longitudinal axis of said trestle, and said platform rails interacting with the undercarriage of said lift carriage providing for the transfer of said lift carriage towards the coke-charging means of said vertical quenching chamber when said undercarriage is in contact with said railway line.

5. A plant according to claim 1 or 3 wherein said means for transferring said lift carriage in a horizontal plane comprises:

four pairs of driven balance trucks forming an undercarriage for said lift carriage; one of said balance trucks in each said pair being raisable and located perpendicularly to the other of said balance trucks; and means for raising said one of said balance trucks.

6. A plant according to claim 1 or 3, wherein said means for transferring said lift carriage in a horizontal plane along the trestle and perpendicularly thereto comprises:

four driven balance trucks forming an undercarriage for said lift carriage; and a hoisting jack mounted on said lift carriage for raising said lift carriage from the rails on said trestle.

7. A plant according to claim 1 or 3, including a vertical axle for each of said balance trucks, each of said balance trucks being mounted on one of said axles;

means for rotating each of said balance trucks on its said axle; and hoisting jacks mounted on said lift carriage for raising thereof during rotation of said balance trucks.

* * * * *